US005617832A

United States Patent [19]

Yamazaki et al.

[11] Patent Number: 5,617,832

[45] Date of Patent: Apr. 8, 1997

[54] EVAPORATIVE FUEL-PROCESSING SYSTEM FOR INTERNAL COMBUSTION ENGINES

[75] Inventors: Kazumi Yamazaki; Takeshi Hara; Teruo Wakashiro; Koichi Hidano, all of Wako, Japan

[73] Assignee: Honda Giken Kogyo Kabushiki Kaisha, Tokyo, Japan

[21] Appl. No.: 658,077

[22] Filed: Jun. 4, 1996

[30] Foreign Application Priority Data

Jun. 5, 1995 [JP] Japan ..... 7-161383

[51] Int. Cl.[6] ..... F02M 33/02

[52] U.S. Cl. ..... 123/520; 123/198 D

[58] Field of Search ..... 123/520, 518, 123/519, 521, 516, 198 D

[56] References Cited

U.S. PATENT DOCUMENTS

| | | | |
|---|---|---|---|
| 5,027,780 | 7/1991 | Uranishi | 123/520 |
| 5,174,265 | 12/1992 | Sekine | 123/520 |
| 5,197,442 | 3/1993 | Blumenstock | 123/520 |
| 5,277,168 | 1/1994 | Kondo | 123/519 |
| 5,363,828 | 11/1994 | Yamashita | 123/198 D |
| 5,437,257 | 8/1995 | Giacomazzi | 123/198 D |
| 5,441,031 | 8/1995 | Kiyomiya | 123/520 |
| 5,448,980 | 9/1995 | Kawamura | 123/198 D |
| 5,450,834 | 9/1995 | Yamanaka | 123/520 |
| 5,456,237 | 10/1995 | Yamazaki | 123/519 |
| 5,474,048 | 12/1995 | Yamazaki | 123/519 |

FOREIGN PATENT DOCUMENTS 5-79408 3/1993 Japan .

*Primary Examiner*—Carl S. Miller

*Attorney, Agent, or Firm*—Nikaido, Marmelstein, Murray & Oram LLP

[57] ABSTRACT

An evaporative fuel-processing system for an internal combustion engine comprises an evaporative emission control system including a canister having an air inlet port formed therein for introducing atmosphere into the canister and accommodating an adsorbent for adsorbing evaporative fuel generated in the fuel tank. A charging passage connects between the canister and the fuel tank. A two-way valve is arranged across the charging passage. A purging passage connects between the canister and the intake system. A purge control valve is arranged across the purging passage. An ECU carries out leak-checking of the evaporative emission control system. A negative pressure responsive-type bypass valve is arranged across a bypass passage bypassing the two-way valve. A negative pressure responsive-type vent shut valve is disposed to open and close the air inlet port of the canister. The ECU controls the bypass valve and the vent shut valve to open and close, by means of negative pressure developed within the intake system.

6 Claims, 4 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which purges evaporative fuel generated in the fuel tank into the intake system of the engine, and more particularly to an evaporative fuel-processing system of this kind, which has a function of determining whether or not a leak occurs in the system.

2. Prior Art

There is conventionally known an evaporative fuel-processing system for internal combustion engines, for example, from Japanese Laid-Open Patent Publication (Kokai) No. 5-79408, as shown in FIG. 1. The known evaporative fuel-processing system is comprised of a fuel tank 101, a canister 106 accommodating an adsorbent for adsorbing evaporative fuel generated in the fuel tank 101, an air-introducing passage 108*a* extending from the canister 106 and opening into the atmosphere, a vent shut valve 108 arranged across the air-introducing passage 108*a*, a charging passage 102 connecting between the canister 106 and the fuel tank 101, a two-way valve 104 arranged across the charging passage 102, a passage 102*a* connected to the charging passage 102, which bypasses the two-way valve 104, a bypass valve 105 arranged across the passage 102*a*, a purging passage 107 connecting between the canister 106 and the intake system of the engine, and a purge control valve 109 arranged across the purging passage 107.

The known evaporative fuel-processing system functions such that evaporative fuel generated in the fuel tank 101 is stored in the canister 106 and evaporative fuel is purged from the canister 106 into the intake system when the engine is in a predetermined condition. In the system, the vent shut valve 108, the bypass valve 105, and the purge control valve 109 are each formed by an electromagnetic valve, which has its valving operation controlled by a control unit 111.

The vent shut valve 108 and the bypass valve 105 are provided for carrying out leak-checking, i.e. determining whether there is a leak from the system. Therefore, normally, i.e. when leak-checking is not carried out, the vent shut valve 108 is kept open and the bypass valve 105 is kept closed. On the other hand, when leak-checking is carried out, the vent shut valve 108 is closed and the bypass valve 105 and the purge control valve 109 are opened to allow negative pressure from the intake system of the engine to be introduced into the canister 106 and the fuel tank 101. When the canister 106 and the fuel tank 101 have thus been brought into a predetermined negatively pressurized state, leak-checking is carried out based on an output from a pressure sensor 110 inserted into the charging passage 102.

In the known evaporative fuel-processing system, however, the vent shut valve 108 and the bypass valve 105 are formed by electromagnetic valves which are generally expensive, and therefore the manufacturing cost is high.

SUMMARY OF THE INVENTION

It is the object of the invention to provide an evaporative fuel-processing system for internal combustion engines, which has a leak-checking function and is low in manufacturing cost.

To attain the above object, the present invention provides an evaporative fuel-processing system for an internal combustion engine having a fuel tank and an intake system, comprising:

an evaporative emission control system including a canister having an air inlet port formed therein, for introducing atmosphere into the canister, the canister accommodating an adsorbent for adsorbing evaporative fuel generated in the fuel tank, a charging passage connecting between the canister and the fuel tank, a two-way valve arranged across the charging passage, a purging passage connecting between the canister and the intake system, and a purge control valve arranged across the purging passage;

leak-checking means for carrying out leak-checking of the evaporative emission control system;

a bypass passage bypassing the two-way valve;

a negative pressure responsive-type bypass valve arranged across the bypass passage; and a negative pressure responsive-type vent shut valve disposed to open and close the air inlet port of the canister;

wherein the leak-checking means controls the bypass valve and the vent shut valve to open and close, by means of negative pressure developed within the intake system.

Preferably, the leak-checking means comprises communication passage means connecting the bypass valve and the vent shut valve to the intake system, an electromagnetic valve arranged across the communication passage means, for opening and closing the communication passage means, and control means for controlling the electromagnetic valve.

Also preferably, the leak-checking means carries out the leak-checking of the evaporative emission control system by opening the bypass valve and closing the vent shut valve.

To attain the same object, the present invention also provides an evaporative fuel-processing system for an internal combustion engine having a fuel tank and an intake system, comprising:

an evaporative emission control system including a canister having an air inlet port formed therein, for introducing atmosphere into the canister, the canister accommodating an adsorbent for adsorbing evaporative fuel generated in the fuel tank, a charging passage connecting between the canister and the fuel tank, a two-way valve arranged across the charging passage, a purging passage connecting between the canister and the intake system, and a purge control valve arranged across the purging passage;

leak-checking means for carrying out leak-checking of the evaporative emission control system;

a negative pressure responsive-type vent shut valve disposed to open and close the air inlet port of the canister; and a communication passage connecting between a portion of the charging passage between the two-way valve and the fuel tank and a portion of the purging passage between the purge control valve and the canister;

wherein the leak-checking means controls the vent shut valve to open and close by means of negative pressure developed within the intake system and controls the connecting passage to open and close.

Preferably, the leak-checking means includes an electromagnetic valve arranged across the communication passage, for opening and closing the communication passage, and control means for controlling the electromagnetic valve.

Also preferably, the leak-checking means carries out the leak-checking of the evaporative emission control system by opening the communication passage and closing the vent shut valve.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
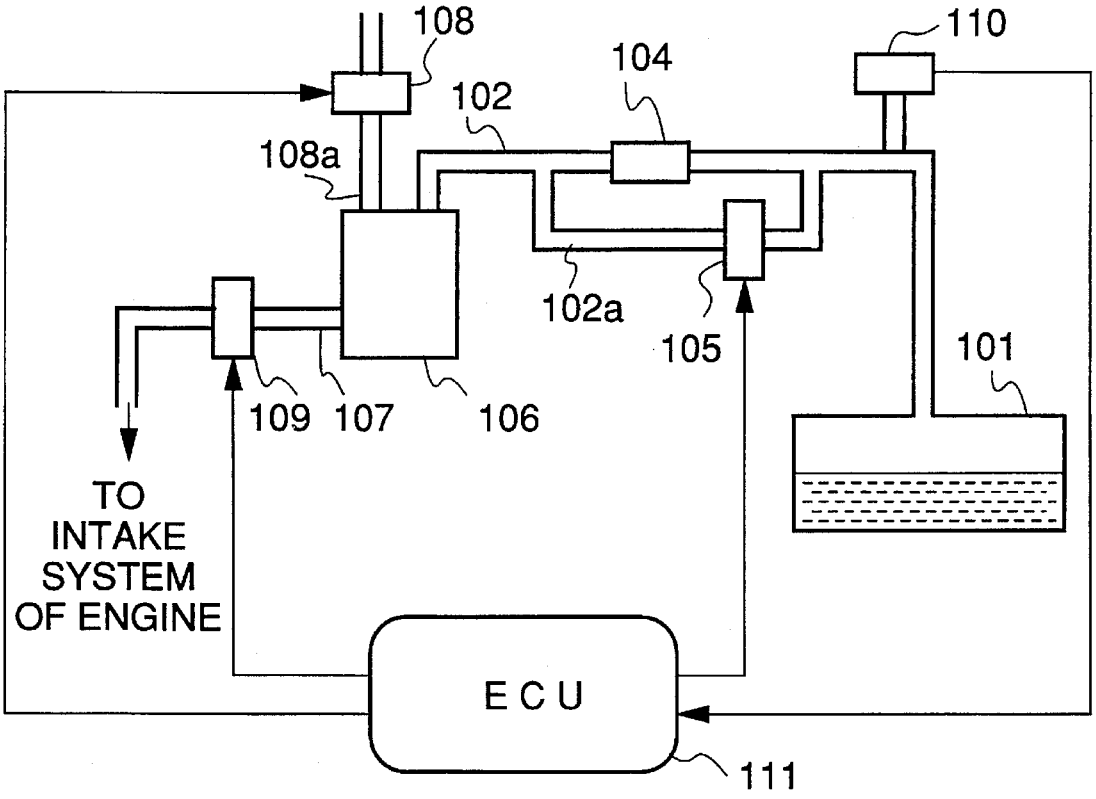
FIG.1 PRIOR ART
FIG. 1 is a schematic view showing the arrangement of a conventional evaporative fuel-processing system for an internal combustion engine.
Figure 2:
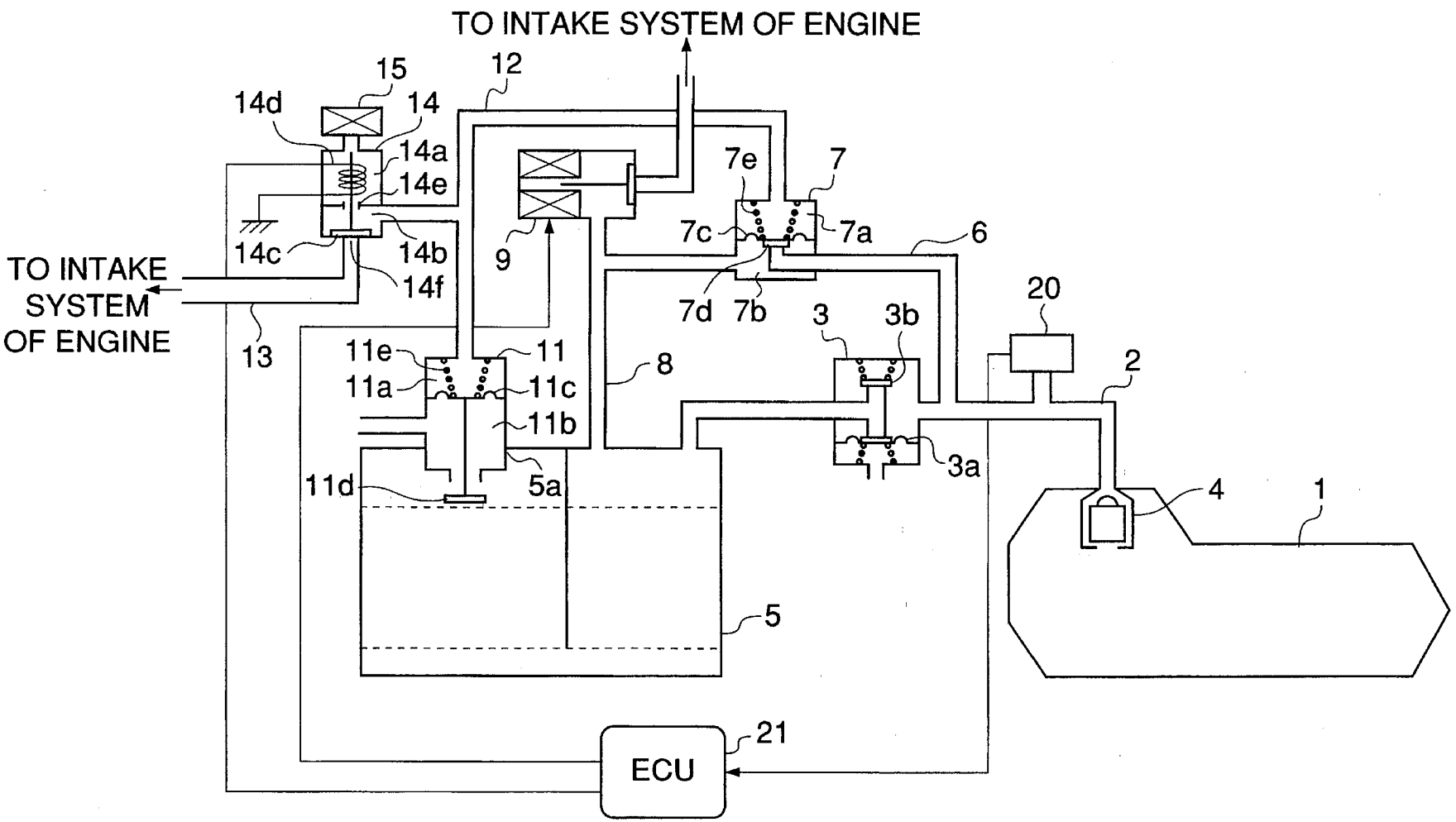
FIG. 2 is a schematic view showing the arrangement of an evaporative fuel-processing system for an internal combustion engine, according to a first embodiment of the invention.

Referring first to FIG. 2, there is illustrated the whole arrangement of an evaporative fuel-processing system for an internal combustion engine, according to a first embodiment of the invention. In the figure, reference numeral 1 designates a fuel tank which is connected via a charging passage 2 to a canister 5 which accommodates therein an adsorbent for adsorbing evaporative fuel generated in the fuel tank 1. Arranged across the charging passage 2 is a two-way valve 3 which is comprised of a positive pressure valve 3*a* which opens when the pressure within the fuel tank 1 exceeds atmospheric pressure by a first predetermined pressure value or more, and a negative pressure valve 3*b* which opens when the pressure within the fuel tank 1 is lower than the pressure within the canister 5 by a second predetermined pressure value or more. A cut-off valve 4 is arranged at one end of the charging passage 2 which opens into the fuel tank 1. The cut-off valve 4 closes when the fuel tank 1 is sharply tilted.

A pressure sensor 20 is inserted into the charging passage 2, for supplying a signal indicative of the sensed pressure within the charging passage 2 to an electronic control unit (hereinafter referred to as the "ECU") 21.

The canister 5 is connected through a purging passage 8 to the intake system of the engine, not shown, at a location downstream of a throttle valve, not shown. Arranged across the purging passage 8 is a purge control valve 9 which is formed by a duty ratio control-type electromagnetic valve. The purge control valve 9 is electrically connected to the ECU 21 to have its valving operation controlled by a signal from the ECU 21. The canister 5, the changing passage 2, the two-way valve 3, the purging passage 8, and the purge control valve 9 constitute an evaporative emission control system.

A bypass passage 6 connects between a portion of the charging passage 2 at a location between the fuel tank 1 and the two-way valve 3, and a portion of the purging passage 8 at a location between the canister 5 and the purge control valve 9, thus bypassing the two-way valve 3. Arranged across the bypass passage 6 is a negative pressure responsive-type bypass valve 7 which is comprised of a first chamber (negative pressure chamber) 7*a* into which negative pressure or vacuum is introduced, a second chamber 7*b* into which the passage 6 opens, a diaphragm 7*c* defining the first chamber 7*a* and the second chamber 7*b*, a valve element 7*d* fixed to the diaphragm 7*c*, and a spring 7*e* for biasing the diaphragm 7*c* in the direction of closing the valve 7.

The canister 5 has formed therein an air inlet port 5*a* for introducing the atmosphere into the canister 5, in which a negative pressure responsive-type vent shut valve 11 is directly mounted. The vent shut valve 11 is comprised of a first chamber (negative pressure chamber) 11*a* into which negative pressure is introduced, a second chamber 11*b* communicating with the atmosphere as well as with the interior of the canister 5, a diaphragm 11*c* defining the first chamber 11*a* and the second chamber 11*b*, a valve element 11*d* having a valve stem thereof fixed to the diaphragm 11*c*, and a spring 11*e* for biasing the diaphragm 11*c* in the direction of opening the valve.

The negative pressure chamber 7*a* of the bypass valve 7 and the negative pressure chamber 11*a* of the vent shut valve 11 are connected to the intake system of the engine at a location downstream of the throttle valve, through communication passages 12 and 13. The communication passage 13 opens at one end thereof into the intake system. Arranged across the communication passage 13 is a control valve 14 formed by an electromagnetic valve, which is comprised of a first chamber 14*a* communicating with the atmosphere via a filter 15, a second chamber 14*b* into which the communication passages 12 and 13 open, a valve element 14*c*, a coil 14*d* electrically connected to the ECU 21, for driving the valve element 14*c*, and a communication hole 14*e* communicating between the first chamber 14*a* and the second chamber 14*b*.

Next, the operation of the evaporative fuel-processing system constructed as above will be described hereinbelow.

In normal operation, i.e. when leak-checking is not carried out, the coil 14*d* of the control valve 14 is not energized, and therefore the control valve 14 is kept in a position as shown in FIG. 2, in which the valve element 14*c* closes a port 14*f* of the second chamber 14*b*. Accordingly, the pressure within the negative pressure chamber 7*a* of the bypass valve 7 and the pressure within the negative pressure chamber 11*a* of the vent shut valve 11 are equal to atmospheric pressure so that the bypass valve 7 is kept closed and the vent shut valve 11 is kept open.

When evaporative fuel is generated in the fuel tank 1 such that the pressure within the fuel tank 1 rises above a certain level, the positive pressure valve 3*a* of the two-way valve 3 opens, whereby evaporative fuel in the fuel tank 1 flows through the charging passage 2 into the canister 5. The evaporative fuel flowing into the canister 5 is adsorbed by the adsorbent, which is purged through the purging passage 8 into the intake system when the engine is operating in a predetermined condition. During purging, the atmosphere flows into the canister 5 through the vent shut valve 11, which forms an air-fuel mixture together with the evaporative fuel, whereby the mixture is supplied to the intake system. During purging, the purge control valve 9 is duty-controlled to control the fuel amount to be purged.

When the pressure within the fuel tank 1 drops due to a drop in the ambient temperature, etc., the negative pressure valve 3*b* of the two-way valve 3 opens, to allow evaporative fuel stored in the canister 5 to return to the fuel tank 1.

When leak-checking is to be carried out, the coil 14*d* of the control valve 14 is energized, whereby the valve element 14*c* closes the communication hole 14*e*. Accordingly, negative pressure prevailing within the intake system is introduced into the negative pressure chamber 7*a* of the bypass valve 7 and the negative pressure chamber 11*a* of the vent shut valve 11, so that the diaphragm 7*c* of the bypass valve 7 is displaced in the direction of opening the valve 7, and the diaphragm 11*c* of the vent shut valve 11 is displaced in the direction of closing the valve 11, whereby the bypass valve 7 is opened while the vent shut valve 11 is closed.

Further, the purge control valve 9 is kept open to introduce negative pressure within the intake system through the purging passage 8 and the bypass passage 6 into the canister 5 and the fuel tank 1. When a pressure value detected by the pressure sensor 20 reaches a predetermined negative pressure value, the ECU 21 closes the purge control valve 9, and then determines whether there is a leak from the evaporative fuel-processing system, based on an output from the pressure sensor 20.

After completion of the leak-checking, the control valve 14 is returned to the state shown in FIG. 2, followed by carrying out the normal operation of the system.

As described above, according to the present embodiment, the vent shut valve 11 and the bypass valve 7 are opened and closed by utilizing negative pressure within the intake system of the engine, and only a single electromagnetic valve is used as the control valve 14. Therefore, the number of electromagnetic valves employed can be decreased, leading to curtailment of the manufacturing cost.

Figure 3:
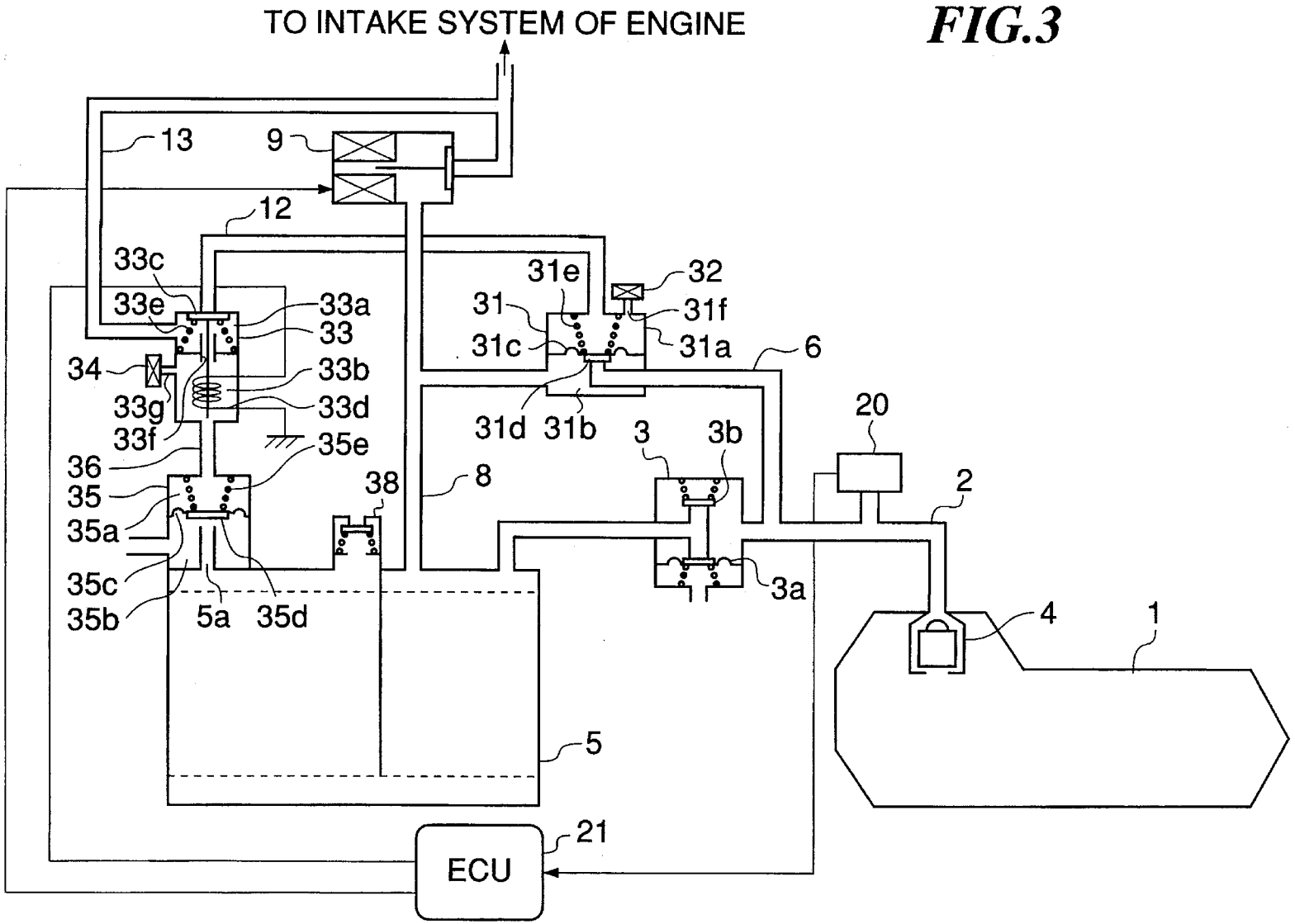
FIG. 3 is a schematic view showing the arrangement of an evaporative fuel-processing system according to a second embodiment of the invention.

FIG. 3 shows the arrangement of an evaporative fuel-processing system according to a second embodiment of the invention. Elements and parts having the same functions as those in FIG. 2 are designated by identical reference numerals, description of which is omitted.

In FIG. 3, a negative pressure responsive-type bypass valve 31 is arranged across the bypass passage 6, which is, similarly to the bypass valve 7 in FIG. 2, comprised of a first chamber (negative pressure chamber) 31*a* into which negative pressure is introduced, a second chamber 31*b* into which the passage 6 opens, a diaphragm 31*c* defining the first chamber 31*a* and the second chamber 31*b*, a valve element 31*d* fixed to the diaphragm 31*c*, and a spring 31*e* for biasing the diaphragm 31*c* in the direction of closing the valve. Further, the negative pressure chamber 31*a* of the bypass valve 31 has therein a restriction 31*f* communicating with the atmosphere via a filter 32.

A negative pressure responsive-type vent shut valve 35 is directly mounted in the air inlet port 5*a* of the canister 5. The vent shut valve 35 is comprised of a first chamber (negative pressure chamber) 35*a* into which negative pressure is introduced, a second chamber 35*b* communicating with the atmosphere and the interior of the canister 5, a diaphragm 35*c* defining the first chamber 35*a* and the second chamber 35*b*, a valve element 35*d* fixed to the diaphragm 35*c*, and a spring 35*e* for biasing the diaphragm 35*c* in the direction of opening the valve 35.

A control valve 33 is connected to the negative pressure chamber 35*a* of the vent shut valve 35 through a passage 36. The control valve 33 is comprised of a first chamber 33*a* into which open the communication passage 13 connected to the intake system (at a location downstream of the throttle valve) and the communication passage 12 connected to the negative pressure chamber 31*a* of the bypass valve 31, a second chamber 33*b* into which the passage 36 opens, a valve element 33*c*, a spring 33*e* for biasing the valve element 33*c* in an upper direction as viewed in the figure (in the direction of closing the communication passage 12), a coil 33*d* electrically connected to the ECU 21, for driving the valve element 33*c*, and a passage 33*f* communicating between the first chamber 33*a* and the second chamber 33*b*. Further, the second chamber 33*b* has therein a restriction 33*g* communicating with the atmosphere via a filter 34.

The canister 5 has a negative pressure valve 38 which opens when the pressure within the canister 5 is below atmospheric pressure by a third predetermined pressure value or more. The third predetermined pressure value is set to such a value that the negative pressure valve 38 does not open when the interior of the canister 5 is set to a predetermined negatively pressurized state during execution of the leak-checking.

Elements and parts other than those mentioned above are identical in arrangement and construction with those in the first embodiment of FIG. 2.

Next, the operation of the evaporative fuel-processing system according to the present embodiment will be described hereinbelow.

In normal operation, i.e. when leak-checking is not carried out, the coil 33*d* of the control valve 33 is not energized, and accordingly the control valve 33 is kept in a position as shown in FIG. 3, in which the valve element 33*c* closes an open end of the communication passage 12. Accordingly, the pressure within the negative pressure chamber 31*a* of the bypass valve 31 is equal to atmospheric pressure, whereby the bypass valve 31 closes. On the other hand, negative pressure within the intake system is introduced into the negative pressure chamber 35*a* of the vent shut valve 35 via the control valve 33, so that the diaphragm 35*c* is displaced in the direction of opening the valve 35, whereby the vent shut valve 35 is kept open. On this occasion, only a small amount of air flows into the negative pressure chamber 33*a* of the control valve 33 through the restriction 33*g*, and accordingly the negative pressure chamber 35*a* is kept in a negatively pressurized state.

When evaporative fuel is generated in the fuel tank 1 during stoppage of the engine, the positive pressure valve 3*a* of the two-way valve 3 opens. Accordingly, the vent shut valve 35 of the canister 5 opens.

Except for the above, the second embodiment is identical in operation with the first embodiment during normal operation.

At leak-checking, the coil 33*d* of the control valve 33 is energized, whereby the valve element 33*c* is displaced to close the communication hole 33*f* and open the open end of the communication passage 12. Accordingly, negative pressure within the intake system is introduced into the negative pressure chamber 31*a* of the bypass valve 32, and the diaphragm 31*c* of the bypass valve 31 is displaced in the valve-opening direction so that the bypass valve 31 opens. On this occasion, only a small amount of air flows into the negative pressure chamber 31*a* through the restriction 31*f*, and accordingly the negative pressure chamber 31 is kept in a negatively pressurized state.

On the other hand, the atmosphere is introduced through the restriction 33*g* into the negative pressure chamber 35*a* of the vent shut valve 35, and accordingly the diaphragm 35*c* of the vent shut valve 35 is displaced in the direction of closing the valve, whereby the vent shut valve 35 closes.

Then, leak-checking is carried out similarly to the first embodiment. After completion of the leak-checking, the control valve 33 is returned to the normal state shown in FIG. 3, followed by carrying out the normal operation of the system.

According to the present embodiment as well, the evaporative fuel-processing system is capable of carrying out leak-checking with a single electromagnetic valve.

Figure 4:
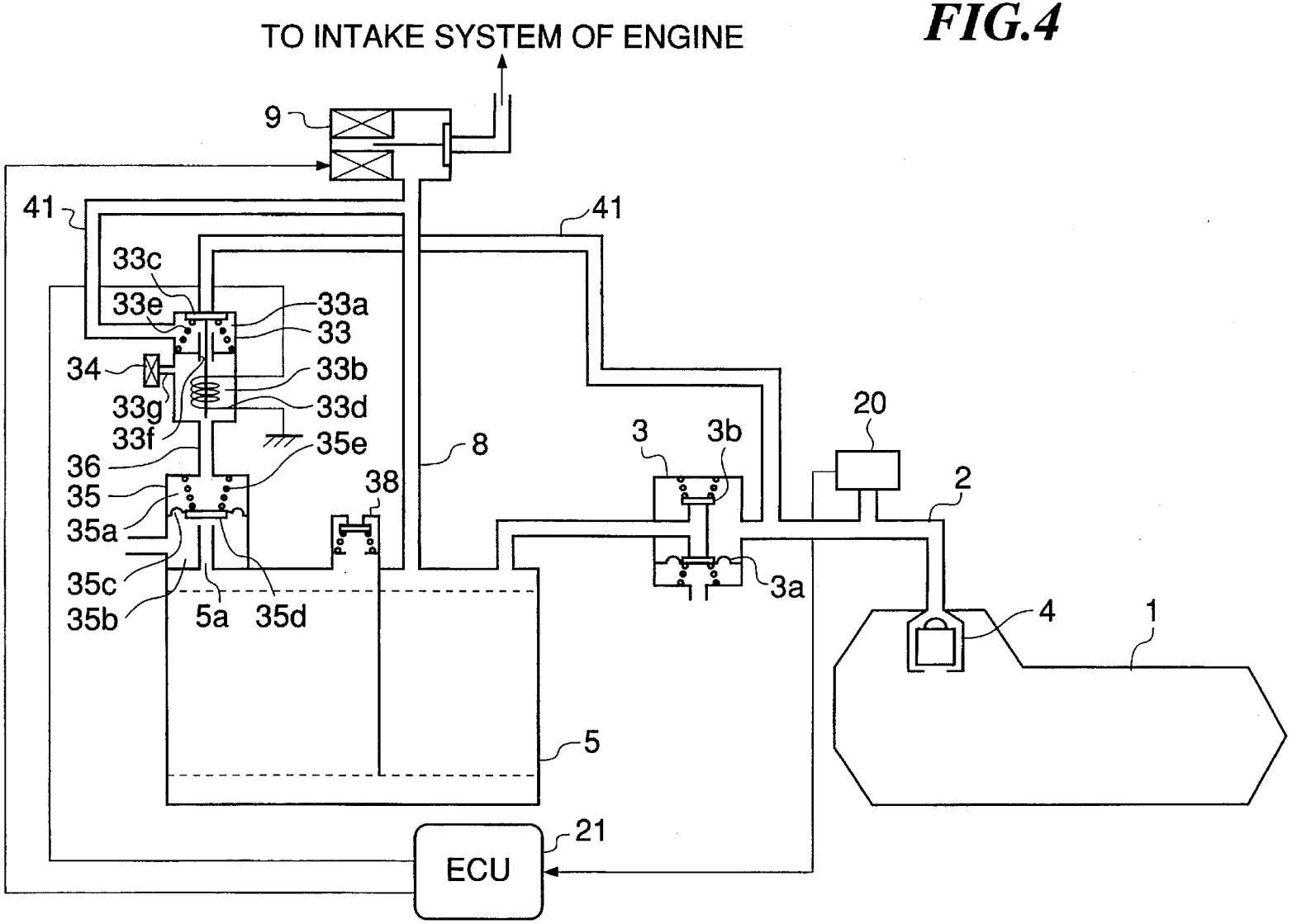
FIG. 4 is a schematic view showing the arrangement of an evaporative fuel-processing system according to a third embodiment of the invention.

FIG. 4 shows the arrangement of an evaporative fuel-processing system according to a third embodiment of the invention. Elements and parts having the same functions as those in the second embodiment are designated by identical reference numerals, description of which is omitted.

According to the present embodiment, a communication passage 41 connects between a portion of the charging passage 2 at a location between the fuel tank 1 and the two-way valve 3 and a portion of the purging passage 8 between the canister 5 and the purge control valve 9. The control valve 33 is arranged across the communication passage 41. As a result, a bypass valve can be omitted from the system.

Elements and parts other than those mentioned above are identical in arrangement and construction with those in the second embodiment of FIG. 3.

Next, the operation of the evaporative fuel-processing system according to the present embodiment will be described hereinbelow.

The operation of the control valve 33 is similar to the operation of the second embodiment. That is, during the normal operation, the communication passage 41 is closed by the control valve 33 while the vent shut valve 35 is opened.

On the other hand, during leak-checking, the communication passage 41 is opened by the control valve 33 while the vent shut valve 35 is closed. Thus, negative pressure is introduced through the passages 8 and 41 into the fuel tank 1, the canister 5, etc., while the air inlet port *5a* of the canister 5 is closed, to thereby carry out leak-checking.

According to the present embodiment, the communication passage 41 is connected at one end thereof to a portion of the purging passage 8 at a location between the purge control valve 9 and the canister, and therefore the use of only a single electromagnetic valve suffices, and further the control valve 33 also acts as a bypass valve, which makes it possible to dispense with the use of a negative pressure responsive-type bypass valve. As a result, further curtailment of the manufacturing cost can be achieved and the reliability of the system is enhanced.

What is claimed is:

1. An evaporative fuel-processing system for an internal combustion engine having a fuel tank and an intake system, comprising:

an evaporative emission control system including a canister having an air inlet port formed therein, for introducing atmosphere into said canister, said canister accommodating an adsorbent for adsorbing evaporative fuel generated in said fuel tank, a charging passage connecting between said canister and said fuel tank, a two-way valve arranged across said charging passage, a purging passage connecting between said canister and said intake system, and a purge control valve arranged across said purging passage;

leak-checking means for carrying out leak-checking of said evaporative emission control system;

a bypass passage bypassing said two-way valve;

a negative pressure responsive-type bypass valve arranged across said bypass passage; and a negative pressure responsive-type vent shut valve disposed to open and close said air inlet port of said canister;

wherein said leak-checking means controls said bypass valve and said vent shut valve to open and close, by means of negative pressure developed within said intake system.

2. An evaporative fuel-processing system as claimed in claim 1, wherein said leak-checking means comprises communication passage means connecting said bypass valve and said vent shut valve to said intake system, an electromagnetic valve arranged across said communication passage means, for opening and closing said communication passage means, and control means for controlling said electromagnetic valve.

3. An evaporative fuel-processing system as claimed in claim 1, wherein said leak-checking means carries out said leak-checking of said evaporative emission control system by opening said bypass valve and closing said vent shut valve.

4. An evaporative fuel-processing system for an internal combustion engine having a fuel tank and an intake system, comprising:

an evaporative emission control system including a canister having an air inlet port formed therein, for introducing atmosphere into said canister, said canister accommodating an adsorbent for adsorbing evaporative fuel generated in said fuel tank, a charging passage connecting between said canister and said fuel tank, a two-way valve arranged across said charging passage, a purging passage connecting between said canister and said intake system, and a purge control valve arranged across said purging passage;

leak-checking means for carrying out leak-checking of said evaporative emission control system;

a negative pressure responsive-type vent shut valve disposed to open and close said air inlet port of said canister; and a communication passage connecting between a portion of said charging passage between said two-way valve and said fuel tank and a portion of said purging passage between said purge control valve and said canister;

wherein said leak-checking means controls said vent shut valve to open and close by means of negative pressure developed within said intake system and controls said connecting passage to open and close.

5. An evaporative fuel-processing system as claimed in claim 4, wherein said leak-checking means includes an electromagnetic valve arranged across said communication passage, for opening and closing said communication passage, and control means for controlling said electromagnetic valve.

6. An evaporative fuel-processing system as claimed in claim 4, wherein said leak-checking means carries out said leak-checking of said evaporative emission control system by opening said communication passage and closing said vent shut valve.

* * * * *